US007156573B2

(12) United States Patent
Bedhome

(10) Patent No.: US 7,156,573 B2
(45) Date of Patent: Jan. 2, 2007

(54) WRITING IMPLEMENT FITTED WITH SUPPORT MEANS FOR THE WRITING TIP

(75) Inventor: Vincent Bedhome, Desvres (FR)

(73) Assignee: Conte, Boulogne Sur Mer (FR)

( * ) Notice: Subject to any disclaimer, the term of this patent is extended or adjusted under 35 U.S.C. 154(b) by 0 days.

(21) Appl. No.: 10/872,193

(22) Filed: Jun. 17, 2004

(65) Prior Publication Data

US 2005/0013651 A1 Jan. 20, 2005

Related U.S. Application Data

(63) Continuation of application No. PCT/FR02/04442, filed on Dec. 18, 2002.

(30) Foreign Application Priority Data

Dec. 18, 2001 (FR) ..... 01 16416

(51) Int. Cl.
*B43K 5/00* (2006.01)
*B43K 8/06* (2006.01)
*B43M 11/06* (2006.01)

(52) U.S. Cl. ..... 401/198; 401/199; 401/223

(58) Field of Classification Search ..... 401/196, 401/198, 199, 207, 223, 238, 239
See application file for complete search history.

(56) References Cited

U.S. PATENT DOCUMENTS 3,353,899 A * 11/1967 Hechtle ..... 401/199
4,723,859 A * 2/1988 Kitoh ..... 401/199
5,651,627 A 7/1997 Dowzall et al. ..... 401/199
6,474,893 B1 * 11/2002 Osada et al. ..... 401/198
6,629,798 B1 * 10/2003 Fukami et al. ..... 401/199

FOREIGN PATENT DOCUMENTS

EP 0 553 441 A1 8/1993
FR 2 654 389 A1 3/1991

* cited by examiner

*Primary Examiner*—Tuan Nguyen
(74) *Attorney, Agent, or Firm*—Jones Day

(57) ABSTRACT

The writing implement of the invention comprises: a) a body including an internal reservoir of ink and having a writing tip projecting from its front end; b) a capillary connector serving to transfer ink between the reservoir and the writing tip; and c) tip support arranged at the front end of the body to support the tip and assemble it with the capillary connector. The implement includes a compact one-piece capillary unit obtained by sintering thermoplastic powder, and constituting simultaneously the capillary connector and all or part of the tip support. The capillary connector and all or part of the tip support are constituted by a compact one-piece capillary unit preferably obtained by sintering thermoplastic powder.

14 Claims, 2 Drawing Sheets

WRITING IMPLEMENT FITTED WITH SUPPORT MEANS FOR THE WRITING TIP

CROSS-REFERENCE TO RELATED APPLICATION

The present application is a continuation of United States National Stage designation of co-pending International Patent Application PCT/FR02/04442, filed on Dec. 18, 2002, which claims priority to French Patent Application No. 01.16416, filed Dec. 18, 2001. The entire content of both these applications is expressly incorporated herein by reference thereto.

FIELD OF THE INVENTION

The present invention relates to a writing implement in which the ink contained in a reservoir of the writing instrument is taken to a writing tip fixed to the front of the body of the implement by tip support means.

BACKGROUND OF THE INVENTION

In a writing implement, the use of tip support means is justified mainly when the tip is fine, or very fine, possibly having a diameter of 0.8 millimeters (mm) to 1 mm. Tips of that type are known that are obtained by extruding a thermoplastic material, in particular polyacetal. Ink is caused to be transferred along the entire length of the writing tip by an internal capillary duct which is provided during extrusion. The maximum length of such a writing tip is about 25 mm, since otherwise there is a considerable risk of the implement becoming unprimed when it is positioned with its tip in the air.

The tip support means that are in general use are made of two parts, a first part being a cylindrical tube in which the writing tip is engaged, and the other part being made of plastics material, surrounding the cylindrical tube and the rear portion of the writing tip. The second part made of plastics material may present a shoulder that is substantially annular, acting as a non-return abutment against the front end of the body of the implement. The tip support means may optionally consist in a single part of plastics material, instead of using the two parts mentioned above.

In order to ensure that ink is transferred from the reservoir that lies within the body of the implement to the writing tip, the implement includes a capillary connector. When the ink is contained in a capillary fiber reservoir, the connector has its rear end penetrating into the fiber mass of the capillary reservoir and its front end surrounding the writing tip. The ink contained in the capillary reservoir migrates, by capillarity, along the entire length of the capillary connector, and penetrates into the writing tip via its internal capillaries.

SUMMARY OF THE INVENTION

The present invention simplifies the fabrication of a writing implement with a fine or very fine writing tip. The writing implement has a body including an internal reservoir of ink and a writing tip projecting from its front end, a capillary connector serving to transfer ink between the reservoir and the writing tip, and a tip support means arranged at the front end of the body to support the tip and to assemble it with the capillary connector.

In a manner characteristic of the invention, the capillary connector and all or part of the tip support are constituted by a compact one-piece capillary unit obtained by sintering thermoplastic powder.

While the thermoplastic powder is being sintered, an array of open pores is obtained enabling ink to be transferred by capillarity. In addition, sintering powder makes it possible to obtain a unit that is sufficiently compact and thus sufficiently strong to hold the writing tip.

In a first embodiment, the writing implement has a fine tip, and in particular a tip that is very fine and extruded, comprising a first tip support part which is a cylindrical tube in which the tip is engaged. In the present invention, the cylindrical tube and the tip are engaged together in the one-piece capillary unit.

It should be observed that the fine tip, in particular the extruded very fine tip, is generally delivered by the tip manufacturer in its configuration already assembled with the first tip support part. Thus, by means of the present invention, it is possible to fit the body of an implement initially designed for a normal writing tip—requiring a large through diameter—with a fine tip. In particular, the implement can be fitted with a tip that is very fine and extruded, by engaging the fine tip that is preassembled with the first tip support part in a one-piece unit which acts both as a second support means for the fine tip, and in particular a tip that is very fine and extruded, as well as a capillary connector. The one-piece unit is made in a mold which includes elements enabling an internal recess to be formed that makes such engagement possible. In addition, the one-piece unit occupies the entire through diameter of the front portion of the implement body and thus serves to hold the tip in position relative to the body of the implement.

In a second embodiment, the one-piece unit completely replaces the tip support means and the capillary connector. It is naturally this second version which achieves greatest simplification in the manufacture of the writing implement. Because the unit is obtained by sintering a powder, it is possible by a suitable choice of mold to give the unit a configuration that is geometrically complex without requiring individual mechanical finishing. Moreover, such unit is provided with mechanical strength that is sufficient to obtain excellent retention of the tip, even when the diameter of the tip is considerably smaller than the through diameter in the front portion of the implement body. Consequently, it is the one-piece unit that occupies the entire through diameter, bearing against the inside face of the body (and ignoring an air flow channel that is provided during molding).

Furthermore, by suitably mixing powders or fibers, it is possible to cause capillarity and/or strength and/or hydrophilic and/or hydrophobic response relative to the ink to vary locally within the one-piece tip support unit. For example it is possible to ensure that the rear portion of the unit has greater capillarity while the front portion has greater strength and is possibly hydrophobic in nature, the rear portion being the portion whereby ink is transferred from the reservoir to the rear end of the tip.

When the one-piece unit acts both as a capillary connector and as tip support means, the unit advantageously includes a longitudinal recess in which the writing tip can be engaged by force.

Also, preferably, the one-piece unit includes at least one shoulder forming a non-return abutment against a portion of the body of the implement.

In a first variant, an implement is provided with a body with an internal transverse wall defining the front end of a housing for the reservoir, and presenting an opening for passing the connector. The shoulder presented by the one-piece unit is formed towards its rear end, at the location of the front face of the internal transverse wall, and comes to bear against the front face of the internal transverse wall.

In a second variant, the shoulder of the one-piece unit is formed towards the front thereof, bearing against the front end of the body of the implement.

By means of the invention, it is possible to propose a writing implement that is capable of operating alternatively, and as selected by the user, either with a fine or normal writing tip, or else as a marker with a broad writing zone. All that is required for this purpose is that at least one zone of the front portion of the one-piece unit that lies outside the front end of the implement body is fed by capillarity with ink from the reservoir and is arranged so as to act as a broad writing head additional to the writing tip. Thus, the user can either position the implement in such a manner that it is the writing tip which presses against the writing medium, or else can position the implement in such a manner that it is the zone of the one-piece unit that is fed with ink that presses against the writing medium.

Selecting between these two positions depends on the angle of inclination of the implement relative to the writing medium.

If it is desired to avoid it being possible, in a given position, for both the writing tip and the zone of the one-piece unit that is fed with ink to be used together, it is appropriate for the writing zone of the one-piece unit to be inclined relative to the longitudinal axis of the implement passing through the writing tip. This inclination is preferably substantially in a general direction that intersects the longitudinal axis beyond the front end of the writing tip. As a result, when the user uses the ink-fed zone of the one-piece unit for drawing a broad mark on the writing medium, the front end of the writing tip can no longer come into contact with the writing medium, assuming, naturally, that the medium is flat.

The invention also makes it possible to provide new simplifications in the manufacture of writing implements.

One simplification consists in the fact that the one-piece unit may be a part that is symmetrical about a transverse midplane. Under such circumstances, both ends, the front and rear ends, of the one-piece unit preferably include a longitudinal recess suitable for receiving the writing tip as a force-fit. By means of this symmetry, assembly of the implement is greatly facilitated since it is no longer necessary to present the one-piece unit specifically in a predetermined position either for forced engagement of the writing tip or for mounting in the body of the implement.

Another simplification consists in the fact that the one-piece unit possesses a standardized part for manufacturing two distinct types of writing implement, namely an implements as described above having a fine or normal tip, and an implement of the marker type for making broad marks. In the first implement, the part in question is fitted with the writing tip, whereas in the second implement, the part is used on its own without a writing tip.

Even though the invention advantageously relates to implements having a fine writing tip, this application is not exclusive. The writing tip may be a normal tip, or even a writing tip of the ballpoint type or of the roller type.

BRIEF DESCRIPTION OF THE DRAWINGS

The present invention will be better understood on reading the following description of several embodiments of a writing implement having a fine tip fitted with a one-piece unit performing the functions of supporting the tip and of providing a capillary connector, as shown in the accompanying drawings, in which.

DETAILED DESCRIPTION OF THE INVENTION

Figure 1:
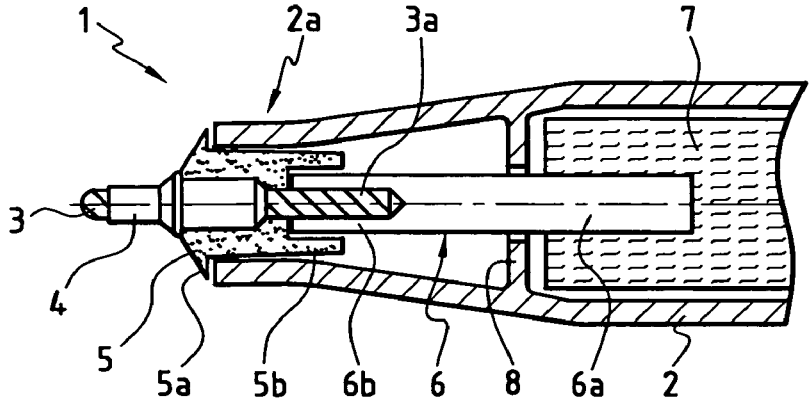
FIG.1 PRIOR ART
FIG. 1 is a diagrammatic and cross-sectional view of a prior art writing implement.

The writing implement 1 shown in FIG. 1 shows the state of the art. It comprises a body 2 having a fine writing tip 3 extending from front end 2*a* of body 2. Writing tip 3 is secured to front end 2*a* by two parts. The first part is a metal tube 4 which is partially surrounded by the second part 5 which is made of plastics material. Second part 5 includes a shoulder 5*a* which bears against front end edge 2*a* of body 2. Towards its rear end, second part 5 also possesses a cylindrical cavity 5*b*. Cavity 5*b* is shaped to receive a capillary connector 6 which connects writing tip 3 to the capillary fiber reservoir 7 that is housed towards the rear of body 2 behind an internal transverse wall 8. As shown in FIG. 1, the rear end 6*a* of capillary connector 6 penetrates into the fiber mass of the capillary reservoir 7, while front end 6*b* surrounds the rear end 3*a* of writing tip 3. During manufacture of the implement, writing tip 3 is first engaged in the metal cylindrical part 4, and is then engaged in the plastics part 5, and finally the capillary connector is engaged in the rear cavity 5*b* of the plastics second part 5.

In the invention, the capillary connector and all or part of the tip support means are constituted by a compact one-piece capillary unit obtained by sintering a thermoplastic powder.

Figure 2:
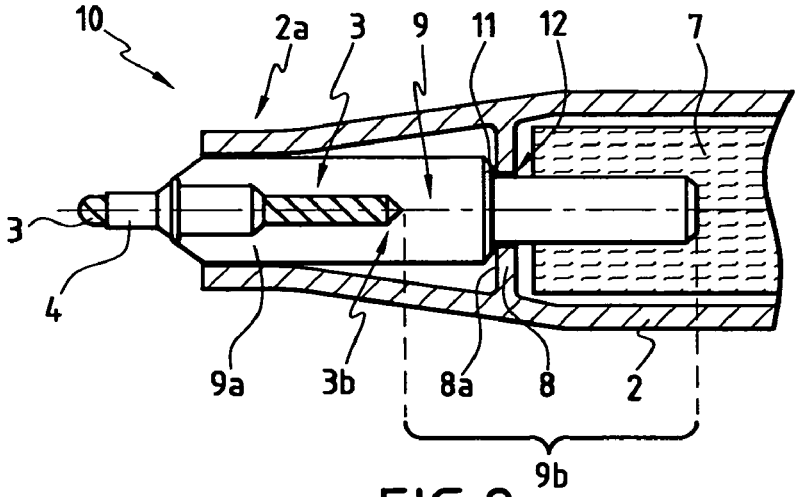
FIG. 2 is a diagrammatic and cross-sectional view of a writing implement constituting a first embodiment of the invention, with a metal tip carrier.

In the first embodiment of the invention, illustrated in FIG. 2, the one-piece unit 9 fitted to the implement 10 replaces the capillary connector and the plastics second part of the example shown in FIG. 1. This one-piece unit 9 presents sufficient capillarity to ensure that ink is transferred from capillary fiber reservoir 7 to writing tip 3, and, more particularly, when tip 3 is an extruded tip, to the rear end 3*b* of tip 3, i.e., to the inlet of the longitudinal internal capillary contained in tip 3. In addition, this one-piece unit 9 is sufficiently strong to hold writing tip 3 in place, i.e., to act as the tip support of the second part 5*a*. This capillarity and this strength are obtained simultaneously in particular by using, as the thermoplastic powder, a polyethylene powder sold under the name and the reference HOSTALEN GHR 8110, having a mean size of about 120 micrometers (μm). After sintering in a suitable mold, e.g., made of aluminum, at a temperature of 200° C. for about 5 minutes (min), a compact one-piece unit is obtained with open pores having a mean pore size of the order of 15 μm and possessing mechanical strength of 4:3 Newtons per square millimeter ($N/mm^2$). The internal recess of the one-piece unit that enables tip 3 and metal tube 4 to be engaged is made directly during molding, or optionally by mechanical finishing.

In the most usual case, the capillarity and strength properties are not desired to be identical throughout the entire volume of one-piece unit 9. Mechanical strength is desirable for front portion 9*a*, which serves to hold tip 3 precisely, and, in the example of FIG. 2, which holds metal part 4 inside front end 2*a* of body 2 of implement 10. Capillarity is desirable for the rear portion 9*b* of one-piece unit 9, i.e., the portion which transfers ink as mentioned above. It is thus possible by using a suitable mixture of powder to make a one-piece unit 9 which, although a single piece, nevertheless presents non-uniformity of structure, being stiffer in its front portion 9*a* and presenting greater capillarity, i.e., being less stiff, in its rear portion 9*b*.

It is also possible, by a suitable mixture of powder or by localized treatment, to avoid ink rising into the front portion 9*a* of one-piece unit 9, and thus to avoid the risk of dirtying the user's fingers. This can be localized treatment that establishes a skin effect in the front portion 9*a*. This may also be achieved by selecting a hydrophobic powder to form front portion 9*a*.

In the example shown in FIG. 2, one-piece unit 9 has a shoulder 11 suitable for coming into abutment against front face 8*a* of the transverse inside wall 8 around through orifice 12. In the example shown, one-piece unit 9 is generally cylindrical in overall shape with a rear portion 9*b* presenting two sections of different diameters, the diameter being smaller than that of through orifice 12 in the rear end portion and being greater than that of through orifice 12 at shoulder 11.

Figure 3:
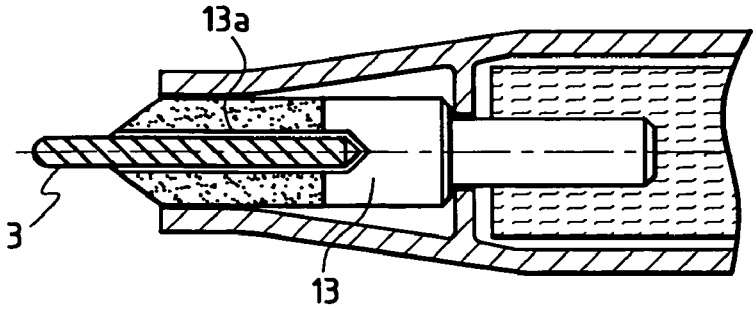
FIG. 3 is a diagrammatic and cross-sectional section view of a writing implement constituting a second embodiment of the invention, in which the one-piece unit completely replaces the tip support means.

The second embodiment of the present invention, shown in FIG. 3, differs from the first embodiment described above by the fact that the one-piece unit 13 replaces simultaneously the capillary connector and all of the means for supporting writing tip 3.

The making of such a one-piece unit is further simplified compared with the preceding example since, for putting writing tip 3 into place, it suffices to provide a longitudinally-extending internal recess 13*a* which is made during molding so that the inside diameter enables writing tip 3 to be engaged as a force-fit. Once this force-fit engagement has been achieved, it is very difficult to extract writing tip 3 from one-piece unit 13.

Figure 4:
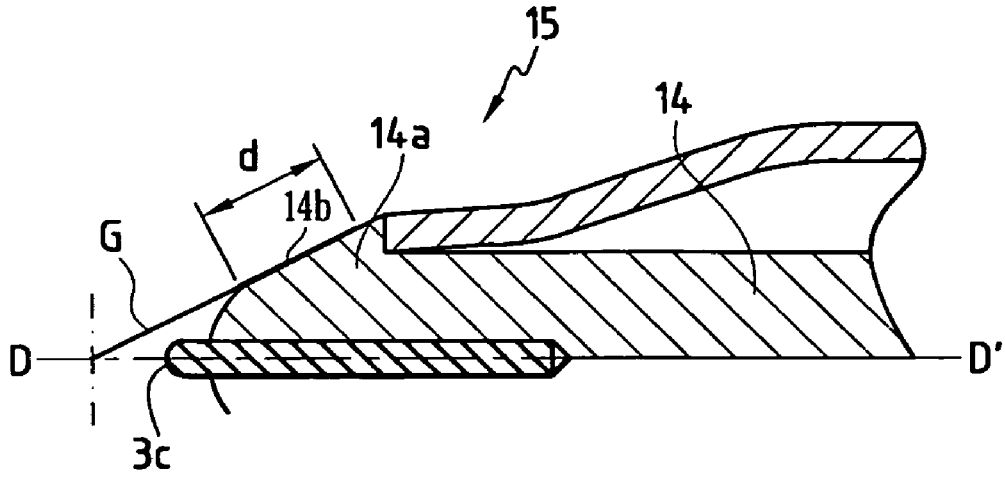
FIG. 4 is a cross-sectional view of a third embodiment of an implement combining fine writing and broad marking.

In the example shown in FIG. 4, writing implement 15 combines two modes of operation, the first being for fine writing with writing tip 3, and the second being for broad writing or marking, with a zone 14*b* situated on the front portion 14*a* of one-piece unit 14, outside the body of implement 15. Naturally, in order to make such operation possible, it is necessary for zone 14*b* also to be fed with ink and thus for the capillarity of one-piece unit 14 to be adapted accordingly. In the example shown, the front portion 14*a* of one-piece unit 14 is substantially frustoconical in shape or possibly pyramid-shaped, so as to provide a zone 14*b* that is suitable for being pressed against the writing medium over a determined length d. It is this length d which corresponds to the width of the marking when the implement is operated in its second mode.

It will be understood that the user can select which mode of operation to use by varying the angle of inclination of the implement while writing on the writing medium. If the implement is held substantially vertically, or inclined to a small extent only, then it is fine writing tip 3 that comes into contact with the writing medium. In contrast, if the implement is inclined so that zone 14*b* comes into contact with the writing medium, then broad marking is obtained.

If it is desired to avoid interference between the two modes of operation, it suffices, as shown in FIG. 4, for the general direction G of zone 14*b* that is fed with ink and that opens out outside body 2 of implement 10 to intersect the longitudinal axis DD' of writing tip 3 beyond the front end 3*c* of tip 3.

When the one-piece unit 13 or 14 is capillary over its entire length, it will be understood that it can itself constitute a writing head for broad marking if a writing tip 3 is not inserted therein. Thus, such a one-piece unit 13, 14 can constitute a standard part in the manufacture of implements of two types, with it being possible to select between types as a function of demand. In the first type of implement, a fine or normal writing tip 3 is engaged in the longitudinal recess in the front portion of the one-piece unit. This provides an implement having a fine or normal writing tip. Otherwise, one-piece unit 13, 14 is used on its own. The writing implement is then for making broad marks.

Figure 5:
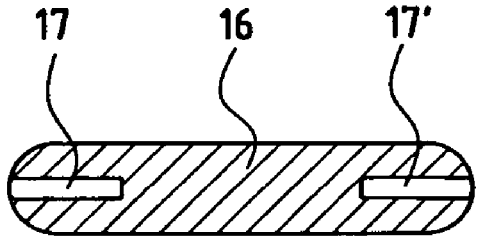
FIG. 5 is a diagrammatic longitudinal cross-sectional view of a symmetrical one-piece unit.

FIG. 5 shows a one-piece unit 16 which is entirely symmetrical about a transverse midplane, possessing two internal longitudinal recesses 17, 17' each suitable for receiving a writing tip 3 as a force-fit. Such a one-piece unit makes it possible to simplify the operations of assembling the implement since it avoids any need to select the orientation of the unit and choose between a front end and a rear end when engaging the writing tip, and/or when mounting it in the body of the implement. In the highly simplified embodiment shown in FIG. 5, one-piece unit 16 can be put into abutment inside the body of the implement only by peripheral indentations projecting into the inside of the body of the implement.

The present invention is not limited to the embodiments described above. The writing tip may be of the ballpoint type or of the roller type.

What is claimed is:

1. A writing implement comprising:

a body having an internal ink reservoir defined therein and a front end with a writing tip projecting therefrom;

a capillary connector, separate from the writing tip, serving to transfer ink between said reservoir and said writing tip; and a writing tip support arranged at the front end of said body to support said writing tip and to assemble said writing tip with said capillary connector;

wherein said writing tip is a separate writing tip and said capillary connector and at least part of the support for the separate writing tip are formed from a compact one-piece capillary unit obtained by sintering thermoplastic powder, and wherein the one-piece capillary unit includes a front portion and a rear portion, the front portion having a greater stiffness than the rear portion.

2. An implement according to claim 1, wherein at least one of the porosity, strength, and a hydrophilic/hydrophobic nature of said one-piece capillary unit relative to the ink varies locally.

3. An implement according to claim 2, wherein:

said one-piece capillary unit has a front portion and a rear portion;

said rear portion has a greater porosity than said front portion; and said front portion is stronger than said rear portion.

4. An implement according to claim 1, further comprising a writing tip and a writing tip support in the form of a cylindrical tube in which said writing tip is engaged;

wherein said cylindrical tube and said writing tip are engaged in said one-piece capillary unit.

5. An implement according to claim 1, wherein:

said one-piece capillary unit performs the functions of capillary connector and writing tip support in full; and said implement includes a longitudinal recess in which said writing tip can be engaged as a force-fit.

6. An implement according to claim 5, wherein at least one zone of a front portion of said one-piece capillary unit located outside the front end of said body of said implement is fed by capillarity with ink from said reservoir and is arranged in such a manner as to act as a broad writing head in addition to said writing tip.

7. An implement according to claim 1, wherein said one-piece capillary unit includes at least one shoulder forming a non-return abutment against a portion of said body of said implement.

8. An implement according to claim 7, wherein:

said body includes an internal transverse wall having a front face and defining a front end of said housing for said reservoir, and presents an opening for passing said connector therethrough; and said shoulder on said one-piece capillary unit is formed towards a rear end of said one-piece capillary unit and is adapted to bear against said front face of said internal transverse wall.

9. An implement according to claim 7, wherein said shoulder of said one-piece capillary unit is formed towards a front of said one-piece capillary unit, bearing against the front end of said body of said implement.

10. An implement according to claim 9, wherein said writing zone of said one-piece capillary unit is inclined relative to a longitudinal axis passing through said writing tip, said inclination being substantially in a general direction that intersects said longitudinal axis beyond the front end of said writing tip.

11. An implement according to claim 1, wherein said one-piece capillary unit is symmetrical about a transverse midplane.

12. An implement according to claim 1, wherein said one-piece capillary unit has open pores with a mean pore size of the order of 15 μm, and a mechanical strength of about 4.3 N/mm2.

13. A compact one-piece capillary unit obtained by sintering thermoplastic powder, including a longitudinal recess in which a separate writing tip can be engaged by force, and acting as a capillary connector and as a support for the separate writing tip, wherein the one-piece capillary unit includes a front portion and a rear portion, the front portion having a greater stiffness than the rear portion.

14. A compact one-piece capillary unit according to claim 13, wherein said one-piece capillary unit has open pores with a mean pore size of the order of 15 μm, and a mechanical strength of about 4.3 N/mm2.

* * * * *